US005799829A

United States Patent [19]

Lier et al.

[11] Patent Number: 5,799,829

[45] Date of Patent: Sep. 1, 1998

[54] MEMBRANE-SEALED TUBE WITH A NEEDLE CLOSURE

[75] Inventors: Rolf Lier, Neustadt; Herbert Densky, Barsinghausen, both of Germany

[73] Assignee: Henkel Kommanditgesellschaft auf Aktien, Duesseldorf, Germany

[21] Appl. No.: 750,658

[22] PCT Filed: Jun. 6, 1995

[86] PCT No.: PCT/EP95/02148

§ 371 Date: Dec. 16, 1996

§ 102(e) Date: Dec. 16, 1996

[87] PCT Pub. No.: WO95/34480

PCT Pub. Date: Dec. 21, 1995

[30] Foreign Application Priority Data

Jun. 15, 1994 [DE] Germany ..... 44 20 719.0

[51] Int. Cl.[6] ..... B67D 5/00

[52] U.S. Cl. ..... 222/83; 222/542; 222/546

[58] Field of Search ..... 222/83, 151, 420, 222/541.2, 542, 546, 563

[56] References Cited

U.S. PATENT DOCUMENTS 5,480,064 1/1996 Yan ..... 222/83

FOREIGN PATENT DOCUMENTS 1074577 10/1954 France .
1232373 10/1960 France .
4126477 2/1993 Germany .

*Primary Examiner*—Gregory L. Huson
*Attorney, Agent, or Firm*—Ernest G. Szoke; Wayne C. Jaeschke; Kenneth Watov

[57] ABSTRACT

The invention includes an adhesive-filled tube comprising a membrane-sealed mouth and a cannula, with a bore extending over is longitudinal axis, inseparably fixed to the mouth, and a closure cap releasably fixed to the cannula with a needle-like spike which is guided for displacement in the bore of the cannula, and which is held fixed by its head elements, the latter being thicker than its needle element, in a starting position in a recess of the closure cap provided with an access opening to the cannula with the opportunity for axial displacement into an opening position piercing the membrane. In particular, the danger of adhesive issuing from the cannula after the membrane has been pierced is reduced. To this end, a closure element is formed on the spike between the head element and the needle element bearing sealingly against the cannula outlet opening in the membrane-piercing opening position of the spike.

6 Claims, 2 Drawing Sheets

MEMBRANE-SEALED TUBE WITH A NEEDLE CLOSURE

BACKGROUND OF THE INVENTION 1.0. Field of the Invention

This invention relates generally to a container for liquid adhesive, more particularly a tube, comprising a membrane-sealed mouth and a cannula—with a bore extending over its longitudinal axis—inseparably fixed to the mouth and a closure cap releasably fixed to the cannula with a needle-like spike which is guided for displacement in the bore of the cannula and which is held fixed by its head element—thicker than its needle element—in a starting position in a recess of the closure cap provided with an access opening to the cannula with the opportunity for axial displacement into a membrane-piercing opening position.

2.0. Discussion of Related Art

Membrane-sealed tubes are known, for example, as adhesive packs for cyanoacrylate adhesives. Before the pack is used for the first time, the membrane is pierced by a needle-like spike so that the contents of the tube are released for emptying.

A container of the type in question is known from DE-A-41 26 477. In this container, a cannula is permanently fixed to the mouth of the tube. A closure cap is screwed onto the cannula. The closure cap is provided with a needle-like spike which is pressed into a recess in the closure cap to pierce the membrane. After the membrane has been pierced, the closure cap can be unscrewed and the adhesive can be removed from the tube through the cannula. The cannula is then closed again by replacing the closure cap, the needle-like spike being introduced with its needle element into the bore of the cannula. This known combination of a membrane-sealed tube and a cannula with a screw-on closure cap has the advantage that, after the container has been used for the first time, the closure cap can be unscrewed for the removal of more adhesive without any danger of the cannula being removed from the mouth of the tube during unscrewing of the closure cap through the presence of adhesive between the needle-like spike or the closure cap and the cannula, which would result in the unintentional escape of large quantities of adhesive from the tube. However, the problem of sealing the cannula outlet opening—with the closure cap screwed on—against the unwanted or unintentional escape of adhesive after the membrane has been pierced is not satisfactorily solved by this known adhesive pack. If, in the known closure, the needle-like spike is in its membrane-piercing opening position with the closure cap screwed on, the outlet opening of the cannula is sealed solely by the needle element of the spike in the cannula. Due to the usual manufacturing tolerances, the outlet opening of the cannula is not always completely sealed so that, when the membrane is pierced, for which purpose the user often holds the tube in one hand and presses the needle-like spike into the closure cap with the other hand, adhesive is in danger of issuing from the cannula and soiling the outer surface of the cannula and the adjoining surfaces of the closure cap. If, then, the closure cap is unscrewed to remove the contents of the tube, the adhesive which has already escaped is in danger of dripping and leading to unwanted soiling. However, the problem also arises that, when the closure cap is screwed back on, these residues of adhesive cause the closure cap and the cannula to stick together. When the contents of the tube are intentionally reused, the closure cap can only be unscrewed with difficulty, in some cases only through the application of force, through the presence of bonding adhesive between the cannula and the closure cap.

SUMMARY OF THE INVENTION

Accordingly, an object of the present invention is to improve the user-friendly properties of a container of the type in question.

In a container of the type mentioned above, the present invention includes a closure element formed on the spike between the head element and the needle element and bears sealingly against the cannula outlet opening in the membrane-piercing opening position of the spike.

If, now, the membrane sealing the mouth of the container according to the invention is pierced for the first time by pressing of the head element of the needle-like spike into the corresponding recess of the closure cap, the closure element seals off the cannula outlet opening in this opening position. No product, for example adhesive, can escape from the cannula. After the closure cap has been unscrewed, the user is able to remove product from the container through the cannula. At the time the closure cap is unscrewed, the user may assume that there has been no escape of product which could cause unintentional soiling, for example through dripping. Even when the closure cap is screwed back on, the danger of an adhesive bond being established between the closure cap and the cannula through the unintentional escape of product is distinctly reduced. In addition, the closure element which bears sealingly against the cannula outlet opening when the closure cap is screwed back on also prevents air from entering the container which could result in unwanted hardening of the contents of the container, for example adhesive.

By virtue of the design of the closure element between the head element and the needle element of the needle-like spike, the container according to the invention with its membrane-sealed mouth, cannula and closure cap is distinguished by improved handling and user-friendly properties.

In another embodiment of the invention which is intended to achieve a particularly good sealing effect of the closure element, the closure element has a conical or rounded outer surface which, in the membrane-piercing opening position, bears sealingly against a correspondingly counter-conical or oppositely rounded inner wall surface of the cannula outlet opening.

In another embodiment of the invention, the sealing effect of the closure element is further improved if, in the membrane-piercing opening position of the spike, the closure element bears sealingly against the wall of the closure cap surrounding the access opening.

To ensure that the needle-like spike always bears sealingly against the outlet opening of the cannula, even after repeated unscrewing and replacement of the closure cap, another embodiment of the invention is characterized in that, in its membrane-piercing opening position, the spike is held fixed against axial displaceability in the recess.

According to another aspect of the invention, fixed holding of the needle-like spike against unintentional axial displacement in its membrane-piercing opening position can be achieved if, at its upper end, the recess is formed internally with an encircling bead which, in the membrane-piercing opening position, grips the head element of the spike on the upper part in the vicinity of a reduction in cross-section of the head element and fixes it by friction.

In another embodiment of the invention, the head element comprises an encircling groove in which the bead engages in the starting position of the spike. In this embodiment, the function of the bead is to fix the spike both in its starting position and in its membrane-piercing opening position.

To ensure inexpensive production of the elements forming the closure of the membrane-sealed container, namely the cannula, the closure cap and the needle-like spike, one preferred embodiment of the invention includes a spike made of plastic. The closure as a whole can thus be made by injection moulding.

A further advantageous embodiment of the invention includes an outlet opening in the cannula which reduces the cross-section of the mouth of the container in the longitudinally axial direction. In this way, a collecting space for product, for example adhesive, possibly issuing from the container (tube), for example when the membrane is pierced for the first time, is created inside the cannula. The cannula outlet opening preferably has the smallest opening cross-section of the cannula bore so that, in this region, the sealing fit between the closure element and the outlet opening of the cannula can be formed on a relatively small surface.

Finally, another embodiment of the invention includes a closure cap fixed to the cannula by screwthreads. This provides for easy handling of the container/tube to uncover the cannula outlet opening and to remove the contents of the container by simply unscrewing of the closure cap. The cannula remains on the container/ tube.

Overall, the invention provides an improved system of a membrane-sealed container and a closure mounted thereon which retains the advantages of the system according to DE-A-41 26 477—to the disclosure of which reference is specifically made in this regard—but which is more user-friendly in its handling by virtue of the improved sealing of the cannula outlet opening by the closure element formed on the needle-like spike. The danger of the contents of the container unintentionally escaping and, particularly in the case of an adhesive, drying out and the danger of an adhesive bond being established between the cannula and the closure cap are substantially reduced.

BRIEF DESCRIPTION OF THE DRAWINGS

The invention is described by way of example in the following with reference to the accompanying drawings, in which like elements are identified by the same reference designation, wherein.

Figure 1:
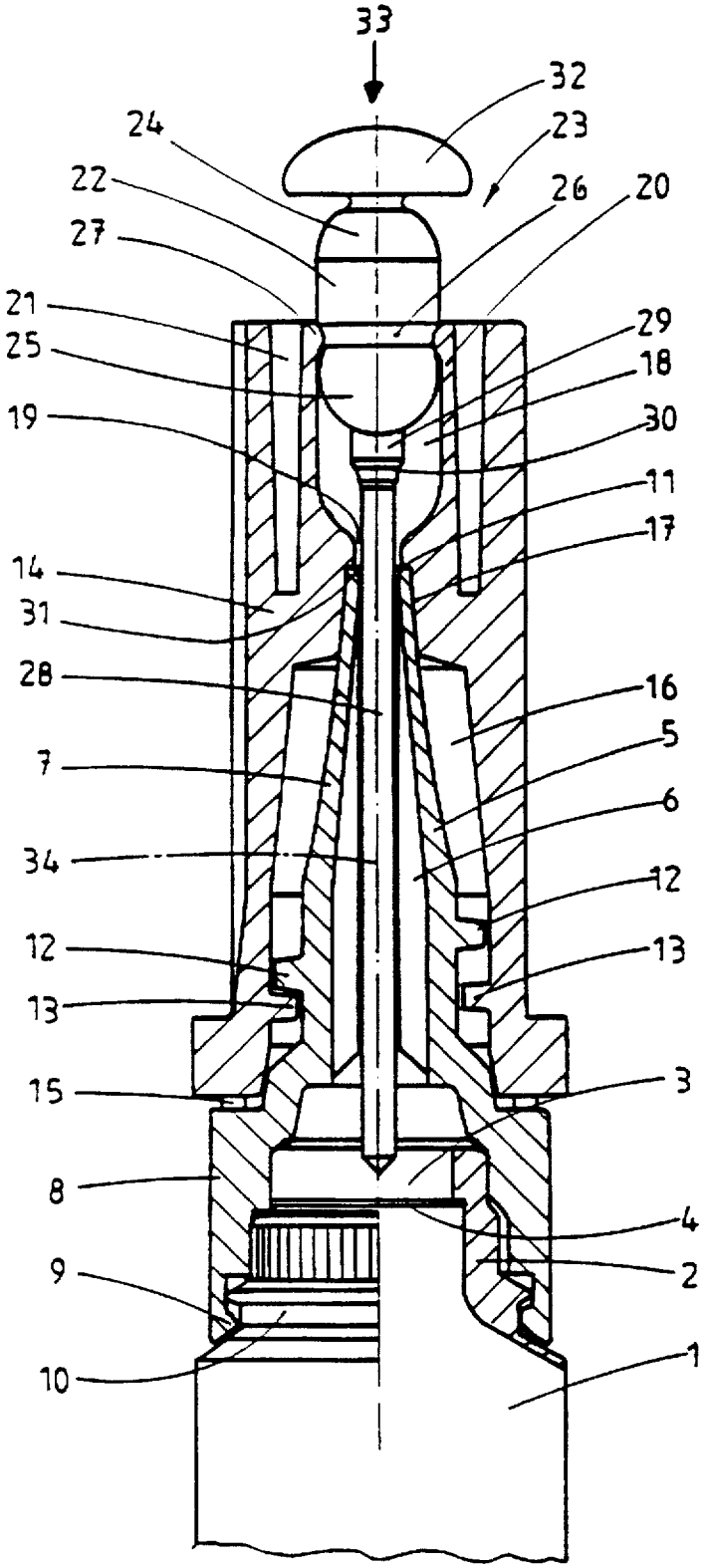
FIG. 1 is a cross-section through the container surmounted by the cannula with the closure cap screwed on and the needle in the starting position.
Figure 2:
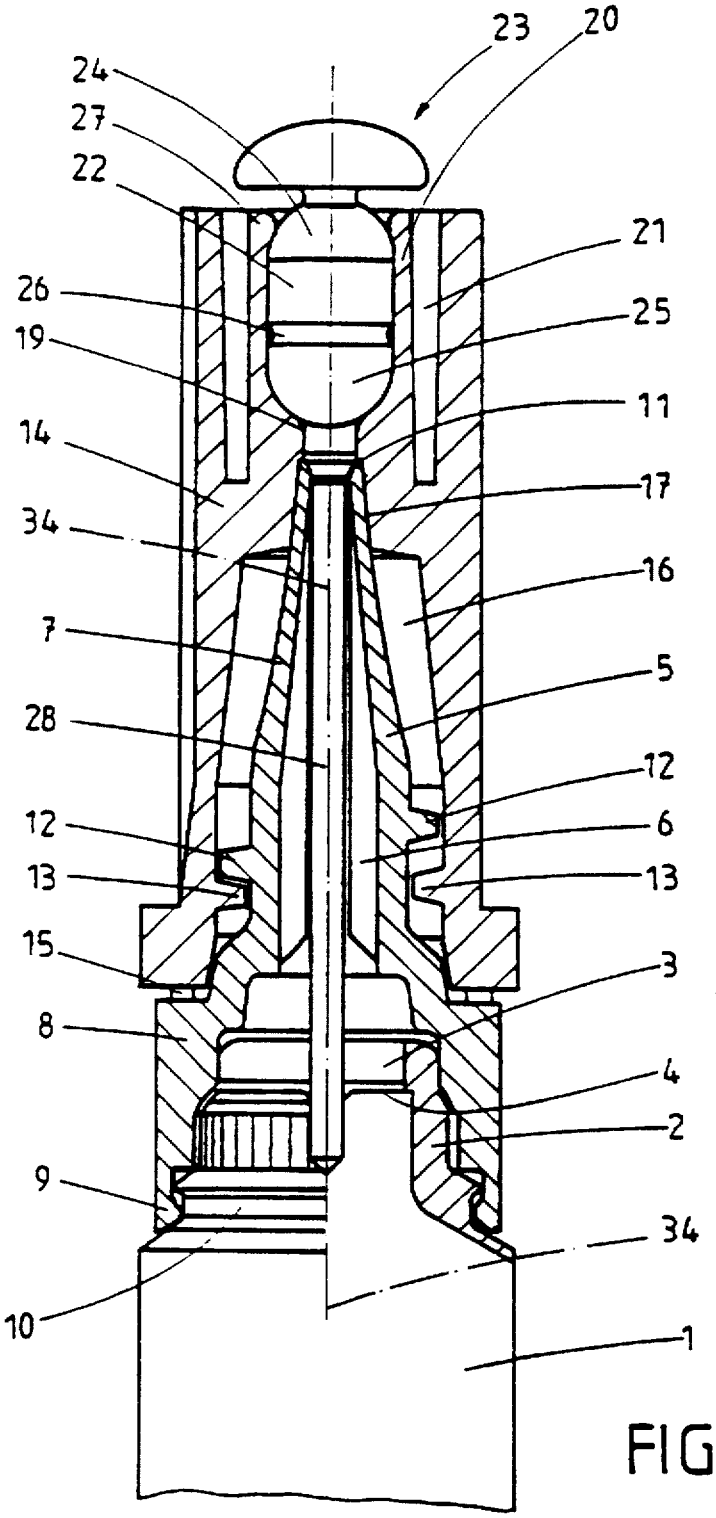
FIG. 2 shows the container surmounted by the cannula with the closure cap screwed on and the needle in the opening position.

The container 1 shown partly in section in FIGS. 1 and 2 is an aluminium tube. Aluminium tubes are used, for example for adhesives, especially cyanoacrylate adhesives. The neck 2 of the tube surrounds the mouth 3 of the container 1. A thin foil-like membrane 4, preferably of aluminium, is formed in the mouth 3 of the container 1. The membrane 4 seals off the interior of the container 1 from the outside. A cannula globally denoted by the reference 5 is inseparably secured to the neck 2 of the tube at the mouth 3 of the container. The cannula 5 consists of an elongate upper part 7 formed with a longitudinally axial bore 6 and a cup-like lower part 8 arranged integrally on the upper part 7. The inner surface of the lower part 8 of the cannula is adapted to the outer shape of the neck 2 of the tube. At its end, the lower part 8 of the cannula 5 is formed on its inner surface with an encircling bead 9 which engages in an encircling groove 10 formed in the neck 2 of the container/ tube 1. The bead 9 is forced into the groove 10 so that the cannula 5 is inseparably fixed to the container 1. The bore 6 extending over the longitudinal axis of the cannula 5 terminates in an outlet opening 11.

The cannula 5 is formed on its outer surface with an outer screwthread 12. This outer screwthread engages in the inner screwthread 13 of a closure cap—globally denoted by the reference 14—screwed onto the cannula 5. When it is fully screwed onto the cannula 5, the substantially cylindrical closure cap 14 is supported by rests 15 formed on an upper edge of the lower part 8 of the cannula. The closure cap 14 is internally hollow, i.e. is formed with a longitudinally axial bore extending throughout the closure cap 14. The bore consists of a lower interior section 16 which is formed with an inner screwthread 13 and of which the diameter is larger than the external diameter of the upper part 7 of the cannula in this zone. The interior section 16 is adjoined by a narrow section 17 which, when the closure cap 14 is screwed onto the cannula 5, borders relatively closely onto the tip of the cannula which ends in this zone. A recess 18 larger in diameter than the narrow section 17 is formed in the closure cap 14 above the section 17. The bottom of the recess 18 is made into a passage-like access opening 19 to the narrow section 17. The recess 18 is substantially cylindrical in shape with a hemispherical base. The recess 18 is surrounded by a cylindrical wall 20 of the closure cap 14 which in turn is surrounded by a recess 21 in the form of an annular slot. The recess 21 terminates at the level of the interior section 17 of the closure cap 14. The relatively thin wall 20 has limited flexibility and elasticity. Arranged in the recess 18 is the head element 22 of a needle-like spike globally denoted by the reference 23. The head element 22 consists of a cylindrical middle part, an adjoining upper part 24 with an arcuately rounded outer surface—designed to reduce the cross-section of the head element 22—and a lower part 25 with a hemispherical surface. In terms of its dimensions, the head element is designed in such a way that its parts 22, 24 and 25 can be fully introduced into the recess 18. At the transition from the middle part to the lower part 25, the head element 22 is formed with an encircling groove 26 in which an annular bead 27 formed on the upper inner edge of the recess 18 engages in the starting position of the needle-like spike 23 shown in FIG. 1. In this way, the spike 23 is held in the recess 18 of the closure cap 14 in such a way that, although fixed in its starting position shown in FIG. 1, it is still axially displaceable as described hereinafter. The spike 23 further comprises a needle 28 which is fixed to the head element 22. The needle 28 has a diameter which is slightly smaller than the diameter of the cannula bore 6 at its outlet opening 11 so that the needle 28 rests with its outer surface on the inner surface of the cannula bore 6 at the cannula outlet opening 11. The head element 22 has a distinctly larger diameter than the needle 28 so that the head element 22 is distinctly thicker than the needle 28. Formed in the transitional zone between the head element 22 and the needle 28 is a closure element 29 which has a smaller diameter than the head element 22 but a larger diameter than the needle 28 and of which the outer wall surface 30 tapers conically to the external diameter of the needle 28. This zone is denoted by the reference 30. The diameter and length of the access opening 19 adjoining the recess 18 are such that the cylindrical part of the closure element 29 can be introduced, the outer surface of the cylindrical part of the closure element 29 and the inner wall surface of the access opening 19 touching one another in this position, as shown in FIG. 2. An inner wall region 31 which tapers counterconically towards the conical wall surface 30 of the closure element 29 is formed on the inner wall of the cannula tip at the cannula outlet opening 11. The walls 30 and 31 also bear sealingly on one another in the cannula outlet opening 11 in the open position of the spike 23 shown in FIG. 2. A mushroom-shaped head 32 is formed on the top of the spike 23. Although the needle-like spike 23 is fixed as a whole, it is still axially displaceable in the closure cap 14. The length of the spike 23 is such that, in the starting position shown in FIG. 1, the tip of the needle 28 ends just above the membrane 4 while the opposite end projects from the top of the closure cap 14.

FIG. 1 shows the container 1 surmounted by the cannula 5 and with the closure cap comprising the needle-like spike 23 screwed onto the cannula 5 in the starting position before the container 1 is used for the first time. To bring the container 1 into use, a pressure is applied to the head 32 in the direction of the arrow 33. When a force of 25 to 50N is exceeded, the snap-action connection between the bead 27 and the groove 26 is broken through the resilience of the wall region 20, and the needle-like spike 23 is axially displaced until the spike 23 reaches the opening position shown in FIG. 2. In this opening position, the tip of the needle 28 has pierced the membrane 4 and thus created an outlet opening for the contents of the container. At the same time, the lower part 25 of the head element 22 rests on the hemispherical base of the recess 18, the cylindrical part of the closure element 29 rests on the wall of the closure cap 14 surrounding the access opening 19 and the conical wall surface 30 of the closure element 29 rests on the counter-conical wall surface 31 at the cannula outlet opening 11. Thus, although the contents of the container 1, for example an adhesive, are able to enter the bore 6 of the cannula 5, they are unable to issue from the cannula 6. In this opening position, the spike 23 is fixed by the bead 27 which now bears with sufficient pressure and corresponding friction on the arcuately rounded surface of the upper part 24 of the head element 22. This press fit is so firm that, when the closure cap 14 is screwed onto and unscrewed from the cannula 5, the spike 23 can no longer be axially displaced within the closure cap 24. The spike 23 remains in the opening position shown in FIG. 2 until the container 1 is completely empty. To remove product from the container 1, the closure cap 14 is unscrewed from the cannula 5. Together with the closure cap 14, the spike 23 is removed from the cannula 5 so that the cannula outlet opening 11 is opened for the removal of product. After the removal of product, the needle 28 of the spike 23 is reintroduced into the cannula outlet opening 11 and the closure cap 14 is screwed onto the cannula 5. This removal and replacement of the closure cap 14 is carried out every time product is to be removed and the container 1 subsequently reclosed. After the first and only movement of the spike 23 from its starting position (FIG. 1) into its opening position (FIG. 2), it is no longer moved relative to the closure cap 14. It remains in its opening position. The mouth 3, the bore 6, the narrow section 17 and the recess 18 with the access opening 19 are arranged concentrically to the longitudinal axis 34. The closure elements (closure cap 14, needle-like spike 23 and cannula 5) are injection-moulded from plastic.

The region 30 of the closure element 29 and the counter-conical region 31 of the cannula 5 may also have other geometric forms; for example, they may have rounded surfaces. The cannula 5 may also be permanently fixed to the neck 2 of the container 1 by welding or bonding.

What is claimed is:

1. A container comprising a tube, said tube including a membrane-sealed mouth and a cannula—with a bore extending over its longitudinal axis—inseparably fixed to the mouth and a closure cap releasably fixed to the cannula with a needle-like spike, which is guided for displacement in the bore of the cannula, and which is held by its head element—thicker than its needle element—in a starting position in a recess of the closure cap provided with an access opening to the cannula, being designed for axial displacement into an opening position piercing the membrane, wherein at its upper end, the recess is formed internally with an encircling bead which, in the starting position of the spike, engages in an encircling groove of the head element and, in the membrane piercing opening position of the spike, grips the head element of the spike on the upper part in the vicinity of a reduction in cross-section of the head elements, and secures it against axial displaceability by friction, via a closure element formed on the spike between the head element and the needle element, that bears sealingly against the cannula outlet opening in the membrane piercing opening position of the spike.

2. A container as claimed in claim 1, wherein the closure element has a conical or rounded outer surface which, in the membrane piercing opening position, bears sealingly against a correspondingly counter-conical or oppositely rounded inner wall surface of the cannula outlet opening.

3. A container as claimed in claim 1, wherein the membrane piercing opening position of the spike, the closure element bears sealingly against the wall of the closure cap surrounding the opening.

4. A container as claimed in claim 1, wherein the spike is made of plastic.

5. A container as claimed in claim 1, wherein the cannula includes an outlet opening which reduces the cross-section of the mouth of the container in the longitudinally axial direction.

6. A container as claimed in claim 1, wherein the closure cap is fixed to the cannula by screwthreads.

* * * * *